US006007977A

United States Patent [19]

Nishikawa

[11] Patent Number: 6,007,977

[45] Date of Patent: Dec. 28, 1999

[54] SILVER HALIDE PHOTOGRAPHIC LIGHT-SENSITIVE MATERIAL

[75] Inventor: Toshihiro Nishikawa, Kanagawa, Japan

[73] Assignee: Fuji Photo Film Co., Ltd., Kanagawa, Japan

[21] Appl. No.: 08/882,492

[22] Filed: Jun. 25, 1997

[30] Foreign Application Priority Data

Aug. 28, 1996 [JP] Japan ..... 8-226923
May 21, 1997 [JP] Japan ..... 9-131491

[51] Int. Cl.[6] ..... G03C 1/02
[52] U.S. Cl. ..... 430/567
[58] Field of Search ..... 430/567

[56] References Cited

U.S. PATENT DOCUMENTS 4,806,461 2/1989 Ikeda et al. ..... 430/567
5,702,878 12/1997 Maruyama ..... 430/567

FOREIGN PATENT DOCUMENTS 62-18552 1/1987 Japan .
63-92942 4/1988 Japan .

*Primary Examiner*—Bernard Dentz
*Attorney, Agent, or Firm*—Sughrue, Mion, Zinn, Macpeak & Seas, PLLC

[57] ABSTRACT

A silver halide photographic light-sensitive material is disclosed, comprising a support having thereon at least one silver halide emulsion layer containing silver chloroiodobromide grains at a proportion of 60% or more of the entire projected area, the grain being a tabular grain which has a dislocation line, an aspect ratio of from 1.5 to 100, a multi-layer structure comprising a core and one or more shell layer in which the core and the shell are different in the halogen composition, said silver chloroiodobromide having a layer containing silver chloride.

6 Claims, No Drawings

SILVER HALIDE PHOTOGRAPHIC LIGHT-SENSITIVE MATERIAL

FIELD OF THE INVENTION

The present invention relates to a silver halide emulsion having excellent sharpness and a light-sensitive material using the same.

BACKGROUND OF THE INVENTION

Among silver halide photographic light-sensitive materials, a color photographic light-sensitive material, particularly a color reversal light-sensitive material which is often used by professional cameraman is in many cases used as an original for printing. As the digital technique proceeds in recent years, various image processing techniques have come to be easily available and relatively cheap printed matters obtained by greatly enlarging a trimmed original are increasing.

Under such circumstances, the color light-sensitive material in recent years is being continuously required to have still more higher image quality, particularly excellent sharpness.

In the field of light-sensitive materials using silver halide, it is known that the silver halide grain itself has light scattering characteristics and largely affects on the sharpness. A silver halide grain having a equivalent-sphere diameter of from 0.2 to 0.6 μm particularly causes large scattering of visible light. For the purpose of improving this scattering, a so-called tabular emulsion having a grain size larger than the grain thickness is used. The production method of a tabular grain and the technique of using the grain are disclosed in U.S. Pat. Nos. 4,386,156, 4,504,570, 4,478,929, 4,414,304, 4,411,986, 4,400,463, 4,414,306, 4,439,520, 4,433,048, 4,434,226, 4,413,053, 4,490,458 and 4,399,215.

On the other hand, as a means for improving the sharpness from the silver halide emulsion side, a technique using development effects (interlayer effect and intralayer effect) is presented. Examples of this technique include a method of using a fogged emulsion in a light-sensitive emulsion layer disclosed in JAP-A-51-128528 (the term "JAP-A" as used herein means an "unexamined published Japanese patent application"), a method of specifying (reducing) the emulsion layer structure and the iodide content in the emulsion to enhance the development effects disclosed in JAP-A-59-64843, and a method of using tabular grains and specifying the iodide content to enhance the development effects disclosed in JAP-A-62-18552.

These methods are certainly effective in increasing the development effects and improving the sharpness, which, however, imposes a serious restriction on the common technique of tabular grains where a high silver iodide layer is localized inside the grain to generate a dislocation line to thereby increase sensitivity or improve pressure property, as disclosed in JAP-A-63-220238.

Under these circumstances, development of a technique for increasing the sensitivity, enhancing the development effects and improving the sharpness using a tabular grain reduced in the light scattering-has been demanded.

SUMMARY OF THE INVENTION

An object of the present invention is to provide a high-sensitive silver halide emulsion having excellent sharpness.

Another object of the present invention is to provide a silver halide photographic light-sensitive material having excellent development effects using the above-described emulsion.

These objects of the present invention can be attained by:

(1) a silver halide photographic light-sensitive material comprising a support having thereon at least one silver halide emulsion layer containing silver chloroiodobromide grains at a proportion of 60% or more of the entire projected area, the grain being a tabular grain which has a dislocation line, an aspect ratio of from 1.5 to 100, a multi-layer structure comprising a core and one or more shell layer in which the core and the shell are different in the halogen composition, said silver chloroiodobromide grain having a layer containing silver chloride.

(2) a silver halide photographic light-sensitive material as described in item (1) above, which comprises at least one silver halide emulsion layer of silver chloroiodobromide grains subjected to selenium sensitization in the presence of a sensitizing dye; and (3) a silver halide photographic light-sensitive material as described in item (1) or (2) above, which comprises at least one silver halide emulsion layer of silver chloroiodobromide grains subjected to reduction sensitization.

DETAILED DESCRIPTION OF THE INVENTION

The present invention is described in detail below.

The tabular emulsion having a dislocation line and an aspect ratio of 1.5 or more for use in the present invention is described below.

The silver halide grains in the silver halide emulsion layer used in the present invention contains tabular silver halide grains having an aspect ratio of 1.5 or more. The term "tabular grain" as used herein is a generic term of grains having one twin plane or two or more parallel twin planes. The term "twin plane" as used herein means a (111) face in the case where ions at all lattice points on both sides of the (111) face are in the spicular relation. When a grain is viewed from the top, the tabular grain has a triangular shape, a hexagonal shape or its rounded circular shape. The triangular, hexagonal or circular grain has triangular, hexagonal or circular outer surfaces parallel to each other, respectively.

The aspect ratio of a tabular grain for use in the present invention is a value obtained by dividing a grain diameter of each grain of the tabular grains having a grain diameter of 0.1 μm or more by the thickness of the grain. The thickness of a grain can be easily measured by depositing a metal together with a latex for reference from the slant direction of a grain, and calculating the grain thickness with reference to the length of shadow of the latex.

The equivalent-circle diameter (grain diameter) as used in the present invention means a diameter of a circle having an area equal to the projected area of the parallel outer surface of a grain.

The projected area of a grain can be obtained by measuring the area on an electron microphotograph and correcting the projection magnification.

The tabular grain preferably has an equivalent-circle diameter of from 0.15 to 10 μm, more preferably from 0.2 to 7 μm, still more preferably from 0.5 to 5 μm. The tabular grain preferably has a thickness of from 0.05 to 1.0 μm, more preferably from 0.08 to 0.8 μm, still more preferably from 0.1 to 0.6 μm.

The average aspect ratio is usually obtained as an arithmetical mean of the aspect ratios of individual grains of at least 100 silver halide grains. The average aspect ratio can also be obtained as a ratio of the average diameter to the average thickness of grains.

In the present invention, tabular silver halide grains having an aspect ratio of from 3 to 100 occupy 60% or more of the entire projected area of silver halide grains in the emulsion layer. Grains having an aspect ratio exceeding 100 are not preferred in view of industrial handling because small thickness of the grains causes instability of the shape.

The above-described tabular grains preferably occupy 70% or more, more preferably 80% or more of the entire projected area.

When tabular grains having a mono disperse grain size distribution are used, further preferred results can be obtained. The structure and the production method of mono disperse tabular grains are described, for example, in JAP-A-63-151618, and the shape thereof is briefly described below. The grains have mono dispersibility such that 70% or more of the entire projected area of silver halide grains are occupied by tabular silver halide grains in the hexagonal shape with the ratio of sides having a maximum length being 2 or less and having two parallel outer surfaces, and the coefficient of the grain size distribution of the hexagonal tabular silver halide grains (a value obtained by dividing the dispersion (standard deviation) in the grain size represented by the circle conversion diameter of the projected area by the average grain size) is 25% or less, preferably 20% or less, most preferably 15% or less.

In the present invention, the tabular grain has a dislocation line. The dislocation line of the tabular grain can be observed by a direct method using a transmission-type electron microscope at a low temperature described, for example, in J. F. Hamilton, *Photo. Sic. E.g.*, 11, 57 (1967) and T. Shiozawa, *J. Soc. Photo. Sic. Japan*, 35, 213 (1972). More specifically, a silver halide grain taken out from an emulsion carefully so as not to apply such a pressure as to cause generation of a dislocation line on the grain is placed on a mesh for observation through an electron microscope and observed according to a transmission method while laying the sample in a cool state so as to prevent any damage (e.g., print out) by the electron beams. At this time, as the thickness of the grain is larger, the electron beams are more difficult to transmit and therefore, a high voltage-type (200 kV or more for the grain having a thickness of 0.25 $\mu$m) electron microscope is preferably used to achieve clearer observation. The site and the number of dislocation lines on each grain can be determined by observing the grain from the direction perpendicular to the major plane on the photograph of the grain obtained as above.

The number of dislocation lines is preferably 5 or more on average, more preferably 10 or more on average, per one grain. In the case when the dislocation lines are present crowdedly or intersected with each other on the observation, the number of dislocation lines per one grain cannot be accurately counted in some cases. However, even in these cases, an approximate number such as about 10, 20 or 30 lines can be counted.

In the present invention, the ratio of the average length of dislocation lines to the grain size is preferably 0.2 or more. The average length of dislocation lines is obtained on individual grain. The dislocation line can be easily observed by the above-described method.

In this case, some dislocation lines observed are born in the center region of the main surface and do not reach the side forming the outer circumference. These are excluded on determining the average length of dislocation lines, and the lengths of only the dislocation lines reaching the side are determined and averaged.

The grain size as used herein means a length of a perpendicular drawn from the center of a tabular grain to the side forming the outer circumference. The center of a tabular grain means a point which comes to a center of a circumscribed circle drawn to pass through the apex of a tabular grain. The ratio of the average length of dislocation lines to the grain size is preferably from 0.20 to 1.0, more preferably from 0.20 to 0.75, still more preferably from 0.20 to 0.50.

The dislocation lines may be present nearly uniformly throughout the entire outer circumference of a tabular grain or may be present at a local site on the outer circumference. More specifically, for example, in the case of a hexagonal tabular silver halide grain, the dislocation lines may be limited only to the neighborhood of six apexes or may be limited only to the neighborhood of one apex among them. On the contrary, the dislocation lines may be limited only to the sides exclusive of the neighborhood of six apexes.

Accordingly, the sites of the dislocation lines may be limited to on the outer circumference, on the major plane (major face) or at the local site as described above, or the dislocation lines may be formed on these sites together, that is, may be present on the outer circumference and on the major plane at the same time.

The method for introducing the dislocation line is described below.

The dislocation line can be introduced into a tabular grain by providing a specific high silver iodide layer inside the grain. The high silver iodide layer as used herein includes a high silver iodide region provided discontinuously. More specifically, in introducing a dislocation line, a substrate grain is prepared, then a high silver iodide layer is provided thereon, and the outer periphery thereof is covered by a layer having a silver iodide content lower than that of the high silver iodide layer. The substrate tabular grain has a silver iodide content lower than that of the high silver iodide layer, preferably of from 0 to 20 mol %, more preferably from 0 to 15 mol %.

The high silver iodide layer inside the grain means a silver halide solid solution containing silver iodide. In this case, the silver halide is preferably silver iodide, silver iodobromide or silver chloroiodobromide, more preferably silver iodide or silver iodobromide (silver iodide content: from 10 to 40 mol %). The high silver iodide layer inside a grain (hereinafter referred to as an "internal high silver iodide layer") can be made present selectively on the side, the corner or the plane of the substrate grain by controlling the production conditions of the substrate grain, the formation conditions of the internal high silver iodide layer and the formation conditions of a layer covering the outer periphery of the layer. With respect to the production conditions of the substrate grain, the pAg (logarithm of a reciprocal of the silver ion concentration) and the presence or absence, the kind, the amount and the temperature of a silver halide solvent are important factors. When the substrate grain is grown at a pAg of 8.5 or less, preferably 8 or less, the internal high silver iodide layer can be made present selectively in the vicinity of the apex or on the plane of the substrate grain. On the other hand, when the substrate grain is grown at a pAg of 8.5 or more, preferably 9 or more, the internal high silver iodide layer can be made present on the side of the substrate grain. The threshold value of the pAg varies depending on the temperature and the presence or absence, the kind and the amount of a silver halide solvent. When, for example, thiocyanate is used as the silver halide solvent, the threshold value of the pAg shifts toward the direction of higher value. In the growth of the substrate grain, the pAg at the final stage is particularly important. However, even when the pAg at the time of growth does not satisfy the above-described value, the selection site of the internal high silver iodide layer can be controlled by ripening the grown substrate grain while adjusting the pAg. At this time, ammonia, an amine compound, a thiourea derivative or a thiocyanate is effective as the silver halide solvent. The internal high silver iodide layer may be formed using a so-called conversion method. This method includes a method of adding halogen ion during the grain formation, in which the halogen ion has a smaller solubility in a salt of forming silver ion, than that of the halogen ion forming the grain or the neighborhood of the grain surface at that time. In the present invention, it is preferred that the halogen ion having a smaller solubility is added in an amount of a certain value (which is related with the halogen composition) or more per the surface area of the grain at that time. For example, KI is preferably added during the grain formation in a certain amount per the surface area of the silver halide grain at that time. Specifically, an iodide salt is preferably added in an amount of from $8.2\times10^{-5}$ to $2.4\times10^{-4}$ mol/m$^2$.

One example of the method for forming an internal high silver iodide layer is a method of adding an aqueous silver salt solution at the same time with the addition of an aqueous halide salt solution containing an iodide salt.

For example, an aqueous $AgNO_3$ solution is added simultaneously with the addition of an aqueous KI solution by a double jet method. At this time, the addition start time and the addition end time of the aqueous KI solution may be earlier or later than those of the aqueous $AgNO_3$ solution. The molar ratio of the aqueous $AgNO_3$ solution to the aqueous KI solution is preferably 0.1 or more, more preferably 0.5 or more, still more preferably 1 or more. The total molar amount of the aqueous $AgNO_3$ solution added may be in a silver excess region to the halogen ion in the system and to the iodine ion added. When the aqueous halide solution containing iodide ion and the aqueous silver salt solution are added by a double jet method, the pAg is preferably reduced as the double jet addition proceeds. The pAg before initiation of the addition is preferably from 6.5 to 13, more preferably from 7.0 to 11. The pAg after completion of the addition is most preferably from 6.5 to 10.0.

In performing the above-described method, the solubility of the silver halide in the mixing system is preferably as low as possible. Accordingly, the temperature in the mixing system at the time of forming a high silver iodide layer is preferably 30 to 80° C., more preferably from 30 to 70° C.

The internal high silver iodide layer is most preferably formed by adding fine grain silver iodide (which means fine silver iodide, hereinafter the same), fine grain silver iodobromide, fine grain silver chloroiodide or fine grain silver chloroiodobromide. In particular, the method is preferably performed by adding fine grain silver iodide. The fine grain usually has a grain size of from 0.01 to 0.1 μm, however, a fine grain having a grain size of less than 0.01 μm or more than 0.1 μm may also be used. The preparation method of the fine grain silver halide grain is described in Japanese Patent Application Nos. 63-7851 (corresponding to JAP-A-1-183417), 63-195778 (corresponding to JAP-A-2-44335), 63-7852 (corresponding to JAP-A-1-183644), 63-7853 (corresponding to JAP-A-1-183645), 63-194861 (corresponding to JAP-A-2-43534) and 63-194862 (JAP-A-2-43535). The internal high silver iodide layer can be provided by adding and then ripening the fine grain silver halide. When the fine grains are dissolved by ripening, the above-described silver halide solvent may also be used. It is not necessary that all of the fine grains added are dissolved and fade away but it is sufficient if they are dissolved and fade away when final grains are accomplished.

The outer layer covering the internal high silver iodide layer has a silver iodide content lower than that of the high silver iodide layer, preferably of from 0 to 30 mol %, more preferably from 0 to 20 mol %, most preferably from 0 to 10 mol %.

The temperature and the pAg when the outer layer covering the internal high silver iodide layer is formed may be freely selected, however, the temperature is preferably from 30 to 80° C., most preferably from 35 to 70° C. The pAg is preferably from 6.5 to 11.5, more preferably from 6.5 to 9.5. Use of the above-described silver halide solvent is preferred in some cases, and the most preferred silver halide solvent is a thiocyanate.

The layer partially containing silver chloride for use in the present invention may be freely provided, for example, as an outermost layer shell or inside a grain.

The outermost layer shell containing silver chloride is formed as follows using the above-described tabular grain having a dislocation line as a core.

At the completion of grain formation of the core layer, excess $Br^-$ in the reaction solution may be removed by water washing or ultrafiltration, or after the completion of addition for forming the core layer, addition of $Br^-$ may be stopped and addition of a silver salt and an aqueous iodide solution may be continued to remove excess $Br^-$ in the reaction solution. Through such an operation, pBr>2.2 is achieved. Then, a chloride salt, for example, NaCl is added, and a silver salt and a halide salt are added in an excess $Cl^-$ concentration at a pCl of from 0.8 to 2.2 to form the shell. The aqueous halide salt solution contains a chloride salt, a bromide salt and an iodide salt, and the component ratio thereof may be appropriately selected depending on the halogen composition of the shell layer.

In case of preventing formation of a steep gradient in the $Cl^-$ or $I^-$ content between the core layer and the outermost layer shell, it may be achieved by changing the component ratio of the aqueous halide salt solution added gradually but not abruptly.

The shell preferably has a silver iodide content of from 0 to 30 mol %, more preferably from 0 to 20 mol %. The shell preferably has a silver chloride content of from 10 to 100 mol %, more preferably from 30 to 100 mol %. The temperature at the formation of shell may be freely selected, however, the temperature is preferably from 30 to 80° C., most preferably from 35 to 70° C.

The outermost layer shell may cover the surface of a silver halide grain completely or may cover a part of the surface selectively. In the present invention, the shell covers 10% or more, preferably 50% or more, still more preferably 100%, of the core surface area.

In the case where a layer containing silver chloride is provided inside a grain, the layer may be provided during preparation of the above-described tabular grain having a dislocation line. For example, before the process of providing a high silver iodide layer inside a grain for introducing a dislocation line, the layer containing silver chloride may be formed in the same manner as in the method of introducing silver chloride into the outermost layer shell.

With respect to the halogen composition of the layer containing silver chloride, a chloride salt, a bromide salt and an iodide salt may be selected at any component ratio within the range of solution limit.

Gelatin is advantageous as a protective colloid used at the preparation of the emulsion for use in the present invention or as a binder in other hydrophilic colloid layers, however, a hydrophilic colloid other than gelatin may also be used.

Examples thereof include proteins such as gelatin derivatives, graft polymers of gelatin to other high polymer, albumin and casein; saccharide derivatives such as cellulose derivatives, e.g., hydroxyethylcellulose, carboxymethyl cellulose and cellulose sulfate, sodium arginates and starch derivatives; and various synthetic hydrophilic polymer materials such as homopolymers and copolymers of polyvinyl alcohol, polyvinyl alcohol partial acetal, poly-N-vinylpyrrolidone, polyacrylic acid, polymethacrylic acid, polyacrylamide, polyvinyl imidazole or polyvinyl pyrazole.

The gelatin may be a lime-processed gelatin, an acid-processed gelatin or an enzyme-processed gelatin as described in *Bull. Soc. Photo. Japan*, No. 16, p. 30 (1966), and a hydrolysate or enzymolysate of gelatin may also be used.

The emulsion for use in the present invention is preferably desalted by water washing and dispersed in a newly prepared protective colloid. The temperature for water washing may be selected depending upon the purpose, but it is preferably from 5 to 50° C. The pH at the time of water washing may also be selected depending upon the purpose, but it is preferably from 2 to 10, more preferably from 3 to 8. The pAg at the time of water washing may also be selected depending upon the purpose, but it is preferably from 5 to 10. The method of water washing may be selected from the noodle water washing method, the dialysis method using a semipermeable membrane, the centrifugal separation method, the coagulation precipitation method and the ion exchange method. The coagulation precipitation method may be selected from a method using a sulfate, a method using an organic solvent, a method using a water-soluble polymer and a method using a gelatin derivative.

At the time of preparing the emulsion for use in the present invention, it is preferred depending on the purpose to let a metal ion salt be present, for example, during grain formation, at the desilvering step, at the time of chemical sensitization or before coating. The metal ion salt is preferably added at the grain formation when it is doped to a grain and added between after the grain formation and before completion of the chemical sensitization when it is used for modification of the grain surface or as a chemical sensitizer. The metal ion salt may be doped to the entire of a grain, only to the core part, only to the shell part, only to the epitaxial part of a grain, or only to the substrate grain. Examples of the metal include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals may be added if it is in the form of a salt capable of dissolving at the grain formation, such as ammonium salt, acetic acid salt, nitric acid salt, sulfuric acid salt, phosphoric acid salt, hydroxyl salt, 6-coordinated complex salt or 4-coordinated complex salt. Examples thereof include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. The ligand of the coordination compound can be selected from halo, aquo, cyano, cyanate, thiocyanate, nitrosyl, thionitrosyl, oxo and carbonyl. These metal compounds may be used individually or in combination of two or more.

The metal compound is preferably added after dissolving it in water or an appropriate organic solvent such as methanol or acetone. In order to stabilize the solution, a method of adding an aqueous hydrogen halogenide solution (e.g., HCl, HBr) or an alkali halogenide (e.g., KCl, NaCl, KBr, NaBr) may be used. Also, if desired, an acid or an alkali may be added. The metal compound may be added to the reaction vessel either before grain formation or during grain formation. Further, the metal compound may be added to a water-soluble silver salt (e.g., $AgNO_3$) or an aqueous alkali halogenide solution (e.g., NaCl, KBr, KI) and then continuously added during the formation of silver halide grains. Furthermore, a solution may be prepared independently from a water-soluble silver salt or an alkali halogenide and continuously added at an appropriate time during the grain formation. A combination of various addition methods is also preferred.

The method of adding a chalcogenide compound during the preparation of an emulsion described in U.S. Pat. No. 3,772,031 is also useful in some cases. Other than S, Se and Te, a cyanate, a thiocyanate, a selencyanate, a carbonate, a phosphate or an acetate may also be present.

The silver halide grain for use in the present invention may be subjected to sulfur sensitization, selenium sensitization, gold sensitization, palladium sensitization or at least one of noble metal sensitization and reduction sensitization at any step during the preparation of a silver halide emulsion. A combination of two or more sensitization methods is preferred. By selecting the step when the chemical sensitization is performed, various types of emulsions may be prepared. The chemical sensitization specks are embedded, in one type, inside the grain, in another type, embedded in the shallow part from the grain surface, and in still another type, formed on the grain surface. In the emulsion of the present invention, the site of chemical sensitization specks may be selected according to the purpose, however, in general, it is preferred that at least a kind of chemical sensitization specks are formed in the vicinity of the surface.

One of the chemical sensitization which can be preferably used in the present invention is chalcogenide sensitization, noble metal sensitization or a combination of these sensitizations. The chemical sensitization may be performed using an active gelatin as described in T. H. James, *The Theory of the Photographic Process*, 4th ed. Macmillan, pp. 67–76 (1977), or sulfur, selenium, tellurium, gold, platinum, palladium, iridium or a combination of these sensitizing dyes in plurality may be used at a pAg of from 5 to 10, a pH of from 5 to 8 and a temperature of from 30 to 80° C. as described in *Research Disclosure*, Vol. 120, 12008 (April, 1974), *Research Disclosure*, Vol. 34, 13452 (June, 1975), U.S. Pat. Nos. 2,642,361, 3,297,446, 3,772,031, 3,857,711, 3,901,714, 4,266,018 and 3,904,415 and British Patent 1,315,755. In the noble metal sensitization, a noble metal salt such as gold, platinum, palladium or iridium may be used and in particular, gold sensitization, palladium sensitization and a combination use of these two sensitizations are preferred. In the case of gold sensitization, a known compound such as chloroaurate, potassium chloroaurate, potassium aurithiocyanate, gold sulfide or gold selenide may be used. The palladium compound means a palladium divalent salt or quatervalent salt. The preferred palladium compound is represented by $R_2PdX_6$ or $R_2PdX_4$, wherein R represents a hydrogen atom, an alkali metal atom or an ammonium group and X represents a halogen atom such as chlorine, bromine or iodine.

More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound and the palladium compound each is preferably used in combination of a thiocyanate or a selenocyanate.

As the sulfur sensitizer, a hypo, a thiourea-base compound, a rhodanine-base compound and in addition, a sulfur-containing compound described in U.S. Pat. Nos. 3,857,711, 4,266,018 and 4,054,457 may be used. The chemical sensitization may also be carried out in the presence of a so-called chemical sensitization aid. The useful chemical sensitization aid includes compounds known to suppress the fogging and at the same time, increase the sensitivity during the chemical sensitization, such as azaindene, azapyridazine and azapyrimidine. Examples of the chemical sensitization aid modifier are described in U.S. Pat. Nos. 2,131,038, 3,411,914 and 3,554,757, JAP-A-58-126526 and Duffin, *Photographic Emulsion Chemistry* (cited above), pp. 138–143.

To the emulsion for use in the present invention, gold sensitization is preferably applied in combination. The amount of the gold sensitizer is preferably from $1\times10^{-7}$ to $1\times10^{-4}$ mol, more preferably from $5\times10^{-7}$ to $1\times10^{-5}$ mol, per mol of silver halide. The amount of the palladium compound is preferably from $5\times10^{-7}$ to $1\times10^{-3}$ mol, per mol of silver halide. The amount of the thiocyanate compound or the selenocyanate compound is preferably from $1\times10^{-6}$ to $5\times10^{-2}$ mol, per mol of silver halide.

The amount of the sulfur sensitizer used for the silver halide grain of the present invention is preferably from $1\times10^{-7}$ to $1\times10^{-4}$, more preferably from $5\times10^{-7}$ to $1\times10^{-5}$ mol, per mol of silver halide.

The preferred sensitization for the emulsion of the present invention includes selenium sensitization. In the selenium sensitization, a known labile selenium compound is used and specific examples of the selenium compound include colloidal metal selenium, selenoureas (e.g., N,N-dimethylselenourea, N,N-diethylselenourea), selenoketones and selenoamides. The selenium sensitization is preferably used in some cases in combination with sulfur sensitization, noble metal sensitization or both of these sensitizations. In the present invention, the selenium sensitization is preferably used in combination with sulfur sensitization or gold sensitization.

The silver halide emulsion of the present invention is preferably subjected to reduction sensitization during grain formation, before or during chemical sensitization after grain formation, or after chemical sensitization.

The reduction sensitization may be performed by any of a method of adding a reduction sensitizer to the silver halide emulsion, a method of growing or ripening the emulsion in a low pAg atmosphere at a pAg of from 1 to 7 called silver ripening and a method of growing or ripening the emulsion in a high pH atmosphere at a pH of from 8 to 11 called high pH ripening. Two or more of the above-described methods may also be used in combination.

The method of adding a reduction sensitizer is preferred because the reduction-sensitization level can be delicately controlled.

Known examples of the reduction sensitizer include a stannous salt, an ascorbic acid or a derivative thereof, amines and polyamines, a hydrazine derivative, a formamidinesulfinic acid, a silane compound and a borane compound. In the reduction sensitization of the present invention, a compound may be selected from these known reduction sensitizers or two or more compounds may also be used in combination. Preferred compounds as the reduction sensitizer are stannous chloride, thiourea dioxide, dimethylamineborane, an ascorbic acid and a derivative thereof. The addition amount of the reduction sensitizer depends on the preparation condition of the emulsion and must be selected, however, it is suitably from $10^{-7}$ to $10^{-3}$ mol per mol of silver halide.

The reduction sensitizer is dissolved in water or a solvent such as an alcohol, a glycol, a ketone, an ester or an amide, and then added during the grain growth. The reduction sensitizer may be added in advance to the reaction vessel but preferably it is added at an appropriate time during the grain growth. The reduction sensitizer may be added in advance to an aqueous solution of a water-soluble silver salt or a water-soluble alkali halide and silver halide grains may be precipitated using the aqueous solution. Also, it is preferred to add the reduction sensitizer solution by several installments along the grain growth or to continuously add it over a long period of time.

An oxidizing agent for silver is preferably used during the production process of the emulsion of the present invention. The oxidizing agent for silver as used herein means a compound capable of acting on a metal silver to convert it into a silver ion. In particular, a compound which converts very fine silver grains by-produced during grain formation of silver halide grains and chemical sensitization thereof into silver ions is useful. The silver ion produced here may form a difficultly water-soluble silver salt such as silver halide, silver sulfide or silver selenide or may form an easily water-soluble silver salt such as silver nitrate. The oxidizing agent for silver may be either an inorganic material or an organic material. Examples of the inorganic oxidizing agent include ozone, a hydrogen peroxide or an adduct thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), a peroxy acid salt (e.g., $K_2S_2O_8$, $K_2C_2O_6$, $K_2P_2O_8$), a peroxy complex compound (e.g., $K_2[Ti(O_2)C_2O_4].3H_2O$, $4K_2SO_4.Ti(O_2)OH.SO_4.2O$, $Na_3[VO(O_2)(C_2H_4)_2.6H_2O)$, a permanganate (e.g., $KMnO_4$), an oxyacid salt such as a chromate (e.g., $K_2Cr_2O_7$), a halogen element such as iodine and bromine, a perhalogenic salt (e.g., potassium periodate), a salt of high-valence metal (e.g., potassium hexanocyanoferrate) and a thiosulfonate.

Examples of the organic oxidizing agent include quinones such as p-quinone, organic peroxides such as peracetic acid and perbenzoic acid, and active halogen-releasing compounds (e.g., N-bromosuccinimide, chloramine-T, chloramine-B).

Preferred oxidizing agents in the present invention are an inorganic oxidizing agent such as ozone, a hydrogen peroxide or an adduct thereof, a halogen element and a thiosulfonate, and an organic oxidizing agent such as quinones. The oxidizing agent for silver is preferably used in combination with the above-described reduction sensitization. A method where an oxidizing agent is used and then reduction sensitization is conducted, a method reverse thereto or a method where the use of an oxidizing agent and the reduction sensitization concur may be appropriately selected. These methods may be selected and used even during the grain formation or during the chemical sensitization.

Various compounds may be incorporated into the photographic emulsion for use in the present invention so as to prevent fogging or to stabilize photographic capabilities, during preparation, storage or photographic processing of the light-sensitive material. More specifically, a large number of compounds known as an antifoggant or a stabilizer may be added, that is, thiazoles such as benzothiazolium salts, nitroindazoles, nitrobenzimidazoles, chlorobenzimidazoles, bomobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole);

mercaptopyrimidines; mercaptotriazines; thioketo compounds such as oxazolinethione; azaindenes such as triazaindenes, tetrazaindenes (in particular, 4-hydroxy-substituted (1,3,3a,7)tetrazaindenes) and pentazaindenes. For example, those described in U.S. Pat. Nos. 3,954,474 and 3,982,947 and JAP-B-52-28660 (the term "JAP-B" as used herein means an "examined Japanese patent publication") may be used. One preferred compound is the compound described in Japanese Patent Application No. 62-47225. The antifoggant and the stabilizer each may be added at various stages such as before grain formation, during grain formation, after grain formation, at water washing, at dispersion after water washing, before chemical sensitization, during chemical sensitization, after chemical sensitization or before coating, depending upon the purpose. These compounds are added during the preparation of emulsion so as not only to exhibit antifogging and stabilization effects originally intended but also to work for various purposes such as control of crystal habit of a grain, reduction of grain size, reduction of solubility of a grain, control of chemical sensitization or control of dye orientation.

The photographic emulsion for use in the present invention is preferably spectrally sensitized by a methine dye or others so as to provide the effect of the present invention. Examples of the dye used include a cyanine dye, a merocyanine dye, a complex cyanine dye, a complex merocyanine dye, a holopolar cyanine dye, a hemicyanine dye, a styryl dye and a hemioxonol dye. Among these, particularly useful are dyes belonging to the cyanine dye, the merocyanine dye and the complex merocyanine dye. To these dyes, any nucleus commonly used for cyanine dyes as a basic heterocyclic nucleus can be applied. Examples of the nucleus include pyronine nucleus, oxazoline nucleus, thiazoline nucleus, pyrrole nucleus, oxazole nucleus, thiazole nucleus, selenazole nucleus, imidazole nucleus, tetrazole nucleus and pyridine nucleus; a nucleus resulting from fusion of an alicyclic hydrocarbon ring to the above-described nucleus; and a nucleus resulting from fusion of an aromatic hydrocarbon ring to the above-described nucleus, e.g., indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus and quinoline nucleus. These nuclei may have a substituent on the carbon atom thereof.

To the merocyanine dye or complex merocyanine dye, a 5- or 6-membered heterocyclic nucleus such as pyrazolin-5-one nucleus, thiohydantoin nucleus, 2-thioxazolidine-2,4-dione nucleus, thiazolidine-2,4-dione nucleus, rhodanine nucleus and thiobarbituric acid nucleus, may be applied as a nucleus having a ketomethylene structure.

These sensitizing dyes may be used individually or in combination and the combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,946, 3,666,480, 3,672,898, 3,679,428, 3,703,377, 3,769,301, 3,814,609, 3,837,862 and 4,026,707, British Patents 1,344,281 and 1,507,803, JAP-B-43-4936, JAP-B-53-12375, JAP-A-52-110618 and JAP-A-52-109925.

In combination with a sensitizing dye, a dye which by itself does not have a spectral sensitization effect or a compound which absorbs substantially no visible light, but exhibits supersensitization, may be contained in the emulsion.

The time when the spectral sensitizing dye is added to an emulsion may be any stage hitherto considered useful during preparation of the emulsion. Most commonly, the dye is added to the emulsion between after completion of the chemical sensitization and before the coating, but the dye may be added at the same time with a chemical sensitizer to effect spectral sensitization and chemical sensitization simultaneously as described in U.S. Pat. Nos. 3,628,969 and 4,225,666, the dye may be added in advance of the chemical sensitization as described in JAP-A-58-113928, or the dye may be added before completion of the formation of silver halide grains by precipitation to start spectral sensitization. Further, the above-described compound may be added in installments, namely, a part of the compound may be added in advance of the chemical sensitization and the remaining may be added after the chemical sensitization as described in U.S. Pat. No. 4,225,666, and the compound may be added at any time during the formation of silver halide grains as described in U.S. Pat. No. 4,183,756.

The addition amount of the spectral sensitizing dye may be from $4\times10^{-6}$ to $8\times10^{-3}$ mol per mol of silver halide, however, when the silver halide grain size is from 0.2 to 1.2 $\mu$m as a more preferred embodiment, it is more effectively from about $5\times10^{-5}$ to $2\times10^{-3}$ mol per mole of silver halide.

It is sufficient that the light-sensitive material of the present invention comprises a support having provided thereon at least one blue-sensitive silver halide emulsion layer, at least one green-sensitive silver halide emulsion layer and at least one red-sensitive silver halide emulsion layer. At least one of each light-sensitive layer comprises from 3 to 10 light-sensitive emulsion layers and the layers are disposed so that the layer closer to the support is higher in the sensitivity than the layer farther from the support.

A typical example thereof a silver halide photographic light-sensitive material comprising a support having thereon at least one light-sensitive layer comprising a plurality of silver halide emulsion layers which are the same in the color sensitivity but different in the light sensitivity. The light-sensitive layer is a unit light-sensitive layer having color sensitivity to any one of blue light, green light and red light. In a multi-layer silver halide color photographic light-sensitive material, the unit light-sensitive layers are generally disposed in the order, from the support side, of a red color-sensitive layer, a green color-sensitive layer and a blue color-sensitive layer. However, the above-described order of arrangement may be reversed or a different light-sensitive layer may be interposed between the same color sensitive layers.

Further, a light-insensitive layer such as various interlayers may be provided between the silver halide light-sensitive layers or as the outermost layer or the lowermost layer.

The interlayer may contain a coupler or a DIR compound described in JAP-A-61-43748, JAP-A-59-113438, JAP-A-59-113440, JAP-A-61-20037 and JAP-A-61-20038, or may contain a color mixing inhibitor as usually used.

In order to improve color reproducibility, a doner layer (CL) different in the spectral sensitivity distribution from the main light-sensitive layers such as BL, GL and RL and having an interlayer effect described in U.S. Pat. Nos. 4,663,271, 4,705,744 and 4,707,436, JAP-A-62-160448 and JAP-A-63-89850, is preferably disposed adjacent to or in the vicinity of a main light-sensitive layer.

Various techniques and inorganic or organic materials which can be used in the silver halide photographic emulsion for use in the present invention and in the silver halide photographic light-sensitive material using the same, are described in *Research Disclosure* No. 308119 (1989) and ibid., No. 37038 (1955).

In addition, more specifically, examples of the techniques and inorganic or organic materials to which the silver halide photographic emulsion for use in the present invention can be applied are described in European Unexamined Patent Publication 436,938A2 and patents cited in the following.

| Item | Pertinent Portion |
|---|---|
| 1) Silver halide emulsion which can be use in combination | from page 147, line 26 to page 148, line 23 |
| 2) Yellow coupler | from page 137, line 35 to page 146, line 33, and page 149, lines 21 to 23 |
| 3) Magenta coupler | page 149, lines 24 to 28; European Unexamined Patent Publication 421,453A1, from page 3, line 5 to page 25, line 55 |
| 4) Cyan coupler | page 149, lines 29 to 33; European Unexamined Patent Publication 432,804A2, from page 3, line 28 to page 40, line 2 |
| 5) Polymer coupler | page 149, lines 34 to 38; European Unexamined Patent Publication 435,334A2, from page 113, line 39 to page 123, line 37 |
| 6) Colored coupler | from page 53, line 42 to page 137, line 34, and page 149, lines 39 to 45 |
| 7) Other functional couplers | from page 7, line 1 to page 53, line 41, and from page 149, line 46 to page 150, line 3; European Unexamined Patent Publication 435,334A2, from page 3, line 1 to page 29, line 50 |
| 8) Antiseptic, antifungal | page 150, lines 25 to 28 |
| 9) Formalin scavenger | page 149, lines 15 to 17 |
| 10) Other additives | page 153, lines 38 to 47; European Unexamined Patent Publication 421,453A1, from page 75 to line 21 to page 84, line 56, and from page 27, line 40 to page 37, line 40 |
| 11) Dispersion method | page 150, lines 4 to 24 |
| 12) Support | page 150, lines 32 to 34 |
| 13) Layer thickness, and physical properties of layer | page 150, lines 35 to 49 |
| 14) Color development | from page 150, line 50 to page 151, line 47 |
| 15) Desilvering | from page 151, line 48 to page 152, line 53 |
| 16) Automatic developing machine | from page 152, line 54 to page 153, line 2 |
| 17) Water washing, stabilization | page 153, lines 3 to 37 |

The present invention will be described in greater detail with reference to the Examples, however, the present invention should not be construed as being limited thereto.

EXAMPLE 1

Emulsions Z1 to Z12 for use in the present invention were prepared as follows.

(Preparation of Seed Emulsion h1)

1,600 ml of an aqueous solution containing 4.5 g of KBr and 7.9 g of gelatin having an average molecular weight of 15,000 was stirred while keeping it at 40° C. An aqueous $AgNO_3$ (8.9 g) solution and an aqueous KBr (6.2 g) solution were added by a double jet method over 40 seconds. After adding 38 g of gelatin, the temperature was elevated to 58° C. After adding an aqueous $AgNO_3$ (5.6 g) solution, 0.1 mol of ammonia was added and after 15 minutes, the solution was neutralized with an acetic acid to have a pH of 5.0. An aqueous $AgNO_3$ (219 g) solution and an aqueous KBr solution were added by a double jet method over 40 minutes while accelerating the flow rate. At this time, the silver potential was kept at −10 mV to the saturation calomel electrode. After desalting, 50 g of gelatin was added, and the pH and the pAg were adjusted at 40° C. to 5.8 and 8.8, respectively, to prepare a seed emulsion. The resulting seed emulsion contained 1 mol of Ag and 80 g of gelatin, per 1 kg of the emulsion, and comprised tabular grains having an equivalent-circle average diameter of 0.62 μm, a coefficient of variation of the equivalent-circle diameter of 16%, an average thickness of 0.103 μm and an average aspect ratio of 6.0.

(Preparation of Core Emulsion H1)

1,200 ml of an aqueous solution containing 180 g of Seed Emulsion h1, 1.9 g of KBr and 38 g of gelatin was stirred while keeping it at 78° C. After adding thereto 0.5 mg of thiourea dioxide, an aqueous $AgNO_3$ (87.7 g) solution and an aqueous KBr solution were added by a double jet method over 46 minutes while accelerating the flow rate. At this time, the silver potential was kept at −40 mV to the saturation calomel electrode. Thereafter, an aqueous $AgNO_3$ (42.6 g) solution and an aqueous KBr solution were added by a double jet method over 17 minutes. At this time, the silver potential was kept at +40 mV to the saturation calomel electrode.

The silver potential was adjusted to −80 mV by adding 44 mg of sodium ethylthiosulfonate and an aqueous KBr solution. A silver iodide fine grain emulsion having an equivalent-circle average diameter of 0.025 μm and a coefficient of variation of the equivalent-circle diameter of 18% was abruptly added within 5 seconds in an amount of 7.1 g in terms of $AgNO_3$. After 30 seconds, an aqueous $AgNO_3$ (66.4 g) solution was added over 8 minutes at a constant rate. After the addition, the silver potential was −10 mV. The resulting emulsion was washed with water in a usual manner, gelatin was added thereto, and the pH and the pAg were adjusted at 40° C. to 5.8 and 8.8, respectively.

Emulsion H1 comprised tabular grains having an equivalent-circle average diameter of 1.17 μm, a coefficient of variation of the equivalent-circle diameter of 19%, an average thickness of 0.23 μm, an average aspect ratio of 5.0 and an equivalent-sphere average diameter of 0.78 μm. Grains having an aspect ratio of 3 or more occupied 80% or more of the entire projected area.

(Preparation of Core Emulsion H2)

1,200 ml of an aqueous solution containing 180 g of Seed Emulsion h1, 1.9 g of KBr and 38 g of gelatin was stirred while keeping it at 78° C. After adding 0.5 mg of thiourea dioxide, an aqueous $AgNO_3$ (87.7 g) solution, an aqueous KBr solution and an aqueous KI solution (2.6 mol % based on the amount of silver added) by a triple jet method over 46 minutes while accelerating the flow rate. At this time, the silver potential was kept at −40 mV to the saturation calomel electrode. Thereafter, an aqueous $AgNO_3$ (42.6 g) solution and an aqueous KBr solution were added by a double jet method over 17 minutes. At this time, the silver potential was kept at +40 mV to the saturation calomel electrode.

The silver potential was adjusted to −80 mV by adding 44 mg of sodium ethylthiosulfonate and an aqueous KBr solution. After 30 seconds, an aqueous $AgNO_3$ (66.4 g) solution was added over 8 minutes at a constant rate. After the addition, the silver potential was −10 mV. The resulting emulsion was washed with water in a usual manner, gelatin was added, and the pH and the pAg were adjusted at 40° C. to 5.8 and 8.8, respectively.

Emulsion H2 comprised tabular grains having an equivalent-circle average diameter of 1.20 μm, a coefficient of variation of the equivalent-circle diameter of 19%, an average thickness of 0.22 μm, an average aspect ratio of 5.5 and an equivalent-sphere average diameter of 0.78 μm. Grains having an aspect ratio of 3 or more occupied 80% or more of the entire projected area.

Preparation of Outermost Layer Shell

Preparation of AgBr Shell Emulsion Z1

An aqueous gelatin solution (KBr: 2.9 g, gelatin: 15 g, $H_2O$: 300 ml) was added to 700 ml of Emulsion H1

(containing 1 mol of Ag), the pH was adjusted to 5.8, and 70 ml of an aqueous $AgNO_3$ solution (containing 10 g of $AgNO_3$) and 70 ml of an aqueous halide salt solution (containing 8.65 g of KBr) were added over 10 minutes to form a shell layer having an AgBr composition.

The resulting emulsion was washed with water in a usual manner, gelatin was added, and the pH was adjusted to 5.8.

Preparation of $AgBr_{80}Cl_{20}$ Emulsion Z2

An aqueous gelatin solution (NaCl: 6 g, gelatin: 15 g, $H_2O$: 300 ml) was added to 700 ml of Emulsion H1, the pH was adjusted to 5.8, and 70 ml of an $AgNO_3$ solution (containing 10 g of $AgNO_3$) and 70 ml of an aqueous halide salt solution (containing 5.6 g of KBr and 1.5 g of NaCl) were added over 10 minutes to form a shell layer having an $AgBr_{80}Cl_{20}$ composition.

The emulsion was washed with water in a usual manner, gelating was added, and the pH was adjusted to 5.8.

Emulsions Z3 to Z6 shown in Table A below were prepared in the same manner by changing the Br/Cl ratio in the aqueous silver salt solution.

Emulsions Z7 to Z12 shown in Table A below were prepared in the same manner as in the preparation of Emulsions Z1 to Z6 except for changing the core emulsion from H-1 to H-2.

Emulsions Z1 to Z12 were observed through a transmission-type electron microscope of 400 kv at a liquid nitrogen temperature. As a result, in any grain of Z1 to Z6, dislocation lines were present at a high density at the fringe portion of a tabular grain. On the other hand, no dislocation line was observed in the grains of Z7 to Z12.

Emulsions Z1 to Z6 each comprised tabular grains having an equivalent-circle average diameter of 1.19 μm, a coefficient of variation of the equivalent-circle diameter of 19%, an average grain thickness of 0.235 μm, an average aspect ratio of 5.1 and an equivalent-sphere average diameter of 0.795 μm, and grains having an aspect ratio of 3 or more occupied 80% or more of the entire projected area.

Emulsions Z7 to Z12 each comprised tabular grains having an equivalent-circle average diameter of 1.23 μm, a coefficient of variation of the equivalent-circle diameter of 19%, an average grain thickness of 0.225 μm, an average aspect ratio of 5.5 and an equivalent-sphere average diameter of 0.795 μm, and grains having an aspect ratio of 3 or more occupied 80% or more of the entire projected area.

Emulsions Z1 to Z12 each was subjected to optimal chemical sensitization by elevating the temperature to 60° C. and adding dipotassium hexachloroiridate, Sensitizing Dyes S4, S5 and S9, potassium thiocyanate, chloroauric acid, sodium thiosulfate and N,N-dimethylselenourea.

Preparation of Coated Sample

Multi-layer color light-sensitive materials were prepared to have the layers each having the following composition on an undercoated cellulose triacetate film support having a thickness of 127 μm, and designated as Samples 101 to 112. The numerals indicate the addition amount per $m^2$. The effect of the compound added is not limited to the use described below.

| | | |
|---|---|---|
| First Layer: antihalation layer | | |
| Black colloidal silver | | 0.10 g |
| Gelatin | | 1.90 g |
| Ultraviolet Absorbent U-1 | | 0.10 g |
| Ultraviolet Absorbent U-3 | | 0.040 g |
| Ultraviolet Absorbent U-4 | | 0.10 g |

-continued

| | | |
|---|---|---|
| High Boiling Point Organic Solvent Oil-1 | | 0.10 g |
| Fine crystal solid dispersion of Dye E-1 | | 0.10 g |
| Second Layer: interlayer | | |
| Gelatin | | 0.40 g |
| Compound Cpd-C | | 5.0 mg |
| Compound Cpd-J | | 5.0 mg |
| Compound Cpd-K | | 3.0 mg |
| High Boiling Point Organic Solvent Oil-3 | | 0.10 g |
| Dye D-4 | | 0.80 mg |
| Third Layer: interlayer | | |
| Surface- and inside-fogged fine grain silver iodobromide emulsion (average grain size: 0.06 μm, coefficient of variation: 18%, AgI content: 1 mol %) | as silver | 0.050 g |
| Yellow colloidal silver | as silver | 0.030 g |
| Gelatin | | 0.40 g |
| Fourth Layer: low-sensitivity red-sensitive emulsion layer | | |
| Emulsion A | as silver | 0.30 g |
| Emulsion B | as silver | 0.20 g |
| Gelatin | | 0.80 g |
| Coupler C-1 | | 0.15 g |
| Coupler C-2 | | 0.050 g |
| Coupler C-3 | | 0.050 g |
| Coupler C-9 | | 0.050 g |
| Compound Cpd-C | | 5.0 mg |
| Compound Cpd-J | | 5.0 mg |
| High Boiling Point Organic Solvent Oil-2 | | 0.10 g |
| Additive P-1 | | 0.10 g |
| Fifth Layer: medium-sensitivity red-sensitive emulsion layer | | |
| Emulsion B | as silver | 0.20 g |
| Emulsion C | as silver | 0.30 g |
| Gelatin | | 0.80 g |
| Coupler C-1 | | 0.20 g |
| Coupler C-2 | | 0.050 g |
| Coupler C-3 | | 0.20 g |
| High Boiling Point Organic Solvent Oil-2 | | 0.10 g |
| Additive P-1 | | 0.10 g |
| Sixth Layer: high-sensitivity red-sensitive emulsion layer | | |
| Emulsion D | as silver | 0.40 g |
| Gelatin | | 1.10 g |
| Coupler C-1 | | 0.30 g |
| Coupler C-2 | | 0.10 g |
| Coupler C-3 | | 0.70 g |
| Additive P-1 | | 0.10 g |
| Seventh Layer: interlayer | | |
| Gelatin | | 0.60 g |
| Additive M-1 | | 0.30 g |
| Color Mixing Inhibitor Cpd-I | | 2.6 mg |
| Dye D-5 | | 0.020 g |
| Dye D-6 | | 0.010 g |
| Compound Cpd-J | | 5.0 mg |
| High Boiling Point Organic Solvent Oil-1 | | 0.020 g |
| Eighth Layer: interlayer | | |
| Surface- and inside-fogged silver iodobromide emulsion (average grain size: 0.06 μm, coefficient of variation: 16%, AgI content: 0.3 mol %) | as silver | 0.020 g |
| Yellow colloidal silver | as silver | 0.020 g |
| Gelatin | | 1.00 g |
| Additive P-1 | | 0.20 g |
| Color Mixing Inhibitor Cpd-A | | 0.10 g |
| Compound Cpd-C | | 0.10 g |
| Ninth Layer: low-sensitivity green-sensitive emulsion layer | | |
| Emulsion E | as silver | 0.10 g |
| Emulsion F | as silver | 0.20 g |
| Emulsion G | as silver | 0.20 g |
| Gelatin | | 0.50 g |
| Coupler C-4 | | 0.10 g |
| Coupler C-7 | | 0.050 g |
| Coupler C-8 | | 0.10 g |

-continued

| | | |
|---|---|---|
| Compound Cpd-B | | 0.030 g |
| Compound Cpd-D | | 0.020 g |
| Compound Cpd-E | | 0.020 g |
| Compound Cpd-F | | 0.040 g |
| Compound Cpd-J | | 10 mg |
| Compound Cpd-L | | 0.020 g |
| High boiling Point Organic Solvent Oil-1 | | 0.10 g |
| High boiling Point Organic Solvent Oil-2 | | 0.10 g |
| Tenth Layer: medium-sensitivity green-sensitive emulsion layer | | |
| Emulsion G | as silver | 0.50 g |
| Emulsion H | as silver | 0.10 g |
| Gelatin | | 0.60 g |
| Coupler C-4 | | 0.070 g |
| Coupler C-7 | | 0.050 g |
| Coupler C-8 | | 0.050 g |
| Compound Cpd-B | | 0.030 g |
| Compound Cpd-D | | 0.020 g |
| Compound Cpd-E | | 0.020 g |
| Compound Cpd-F | | 0.050 g |
| Compound Cpd-L | | 0.050 g |
| High boiling Point Organic Solvent Oil-2 | | 0.010 g |
| High boiling Point Organic Solvent Oil-4 | | 0.050 g |
| Eleventh Layer: high-sensitivity green-sensitive emulsion layer | | |
| Shown in Table A | as silver | 0.50 g |
| Gelatin | | 1.00 g |
| Coupler C-4 | | 0.20 g |
| Coupler C-7 | | 0.10 g |
| Coupler C-8 | | 0.050 g |
| Compound Cpd-B | | 0.080 g |
| Compound Cpd-E | | 0.020 g |
| Compound Cpd-F | | 0.040 g |
| Compound Cpd-K | | 5.0 mg |
| Compound Cpd-L | | 0.020 g |
| High boiling Point Organic Solvent Oil-1 | | 0.020 g |
| High boiling Point Organic Solvent Oil-2 | | 0.020 g |
| Twelfth Layer: interlayer | | |
| Gelatin | | 0.60 g |
| Compound Cpd-L | | 0.050 g |
| High boiling Point Organic Solvent Oil-1 | | 0.050 g |
| Thirteenth Layer: yellow filter layer | | |
| Yellow colloidal silver | as silver | 0.020 g |
| Gelatin | | 1.10 g |
| Color Mixing Inhibitor Cpd-A | | 0.010 g |
| Compound Cpd-L | | 0.010 g |
| High Boiling Point Organic Solvent Oil-1 | | 0.010 g |
| Fine crystal solid dispersion of Dye E-2 | | 0.030 g |
| Fine crystal solid dispersion of Dye E-3 | | 0.030 g |
| Fourteenth Layer: interlayer | | |
| Gelatin | | 0.60 g |
| Fifteenth Layer: low-sensitivity blue-sensitive emulsion layer | | |
| Emulsion J | as silver | 0.30 g |
| Emulsion K | as silver | 0.30 g |
| Gelatin | | 0.80 g |
| Coupler C-5 | | 0.20 g |
| Coupler C-6 | | 0.10 g |
| Coupler C-10 | | 0.40 g |
| Sixteenth Layer: medium-sensitivity blue-sensitive emulsion layer | | |
| Emulsion L | as silver | 0.30 g |
| Emulsion M | as silver | 0.30 g |
| Gelatin | | 0.90 g |
| Coupler C-5 | | 0.10 g |
| Coupler C-6 | | 0.10 g |
| Coupler C-10 | | 0.60 g |
| Seventeenth Layer: high-sensitivity blue-sensitive emulsion layer | | |
| Emulsion N | as silver | 0.20 g |
| Emulsion O | as silver | 0.20 g |
| Gelatin | | 1.20 g |

-continued

| | | |
|---|---|---|
| Coupler C-5 | | 0.10 g |
| Coupler C-6 | | 0.10 g |
| Coupler C-10 | | 0.60 g |
| High Boiling Point Organic Solvent Oil-2 | | 0.10 g |
| Eighteenth Layer: first protective layer | | |
| Gelatin | | 0.70 g |
| Ultraviolet Absorbent U-1 | | 0.20 g |
| Ultraviolet Absorbent U-2 | | 0.050 g |
| Ultraviolet Absorbent U-5 | | 0.30 g |
| Compound Cpd-G | | 0.050 g |
| Formalin Scavenger Cpd-H | | 0.40 g |
| Dye D-1 | | 0.15 g |
| Dye D-2 | | 0.050 g |
| Dye D-3 | | 0.10 g |
| High Boiling Point Organic Solvent Oil-3 | | 0.10 g |
| Nineteenth Layer: second protective layer | | |
| Colloidal silver | as silver | 0.10 mg |
| Fine grain silver iodobromide emulsion (average grain size: 0.06 μm, silver iodide content: 1 mol %) | as silver | 0.10 g |
| Gelatin | | 0.40 g |
| Twentieth Layer: third protective layer | | |
| Gelatin | | 0.40 g |
| Polymethyl methacrylate (average grain size: 1.5 μm) | | 0.10 g |
| Copolymer of methyl methacrylate and methacrylic acid (6:4) (average grain size: 1.5 μm) | | 0.10 g |
| Silicone Oil SO-1 | | 0.030 g |
| Surface Active Agent W-1 | | 3.0 mg |
| Surface Active Agent W-2 | | 0.030 g |

In addition to the above-described components, Additives F-1 to F-8 were added to all emulsion layers. Further, in addition to the above-described components, Gelatin hardening Agent H-1 and Surface Active Agents W-3, W-4, W-5 and W-6 for coating and emulsification were added to each layer.

Furthermore, phenol, 1,2-benzoisothiazolin-3-one, 2-phenoxyethanol, phenethyl alcohol and butyl p-benzoate were added as an antiseptic or an antifungal.

Preparation of Dispersion of Organic Solid Disperse Dye

Dye E-1 were dispersed as follows. To 1,430 g of a dye wet cake containing 30% of methanol, water and 200 g of Pluronic F88 (an ethylene oxide-propylene oxide block copolymer, produced by BASF AG) were added, and the mixed solution was stirred to obtain a slurry having a dye concentration of 6%. Then, 1,700 ml of zirconia beads having an average particle diameter of 0.5 mm were filled in an ultravisco mill (UVM-2) manufactured by Imex KK, and the slurry was passed therethrough and ground at a peripheral speed of about 10 m/sec and a discharge of 0.5 liter/min for 8 hours. The beads were removed by filtration, water was added to dilute to a dye concentration of 3%, and the solution was heated at 90° C. for 10 hours for stabilization. The resulting dye fine particles had an average particle size of 0.60 μm, and the width of grain size distribution (standard deviation of particle size×100/average particle size) was 18%.

In the same manner, solid dispersions of Dyes E-2 and E-3 were obtained. The average particle size was 0.54 μm or 0.56 μm.

C-1
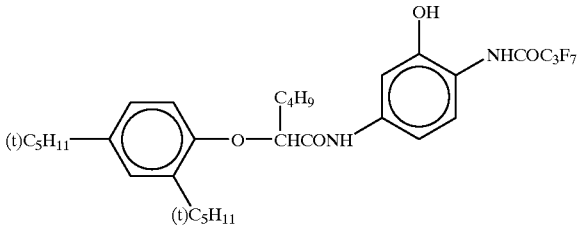
C-2
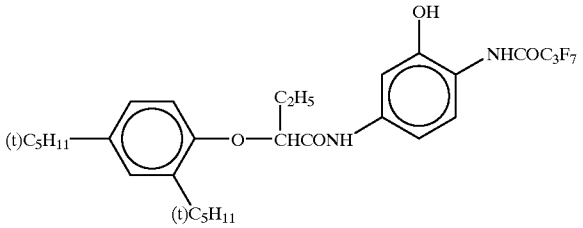
C-3
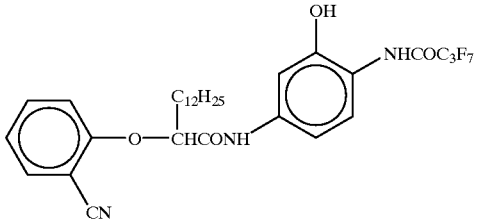
C-4
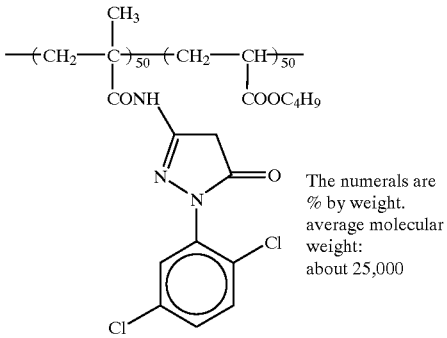
C-5
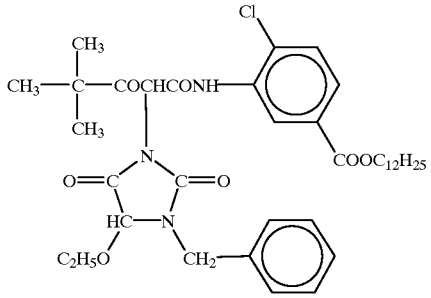

-continued
C-6
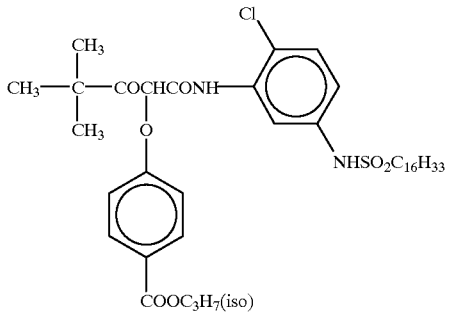
C-7
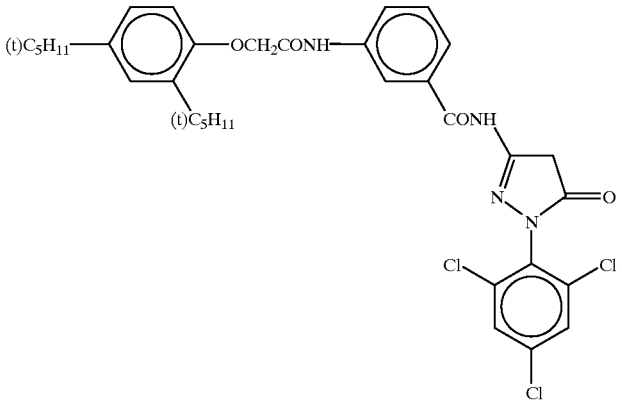
C-8
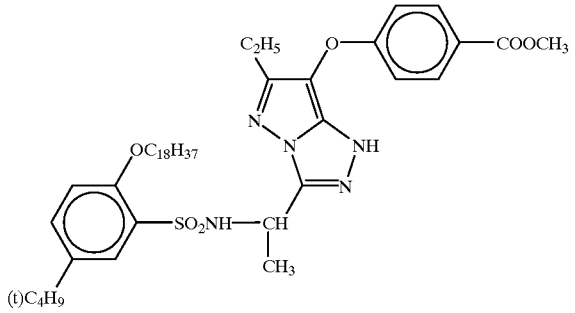
C-9
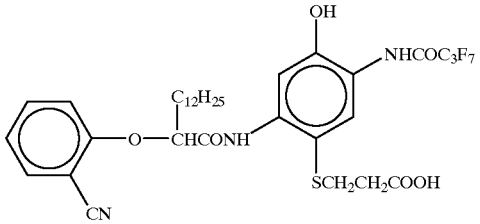
C-10
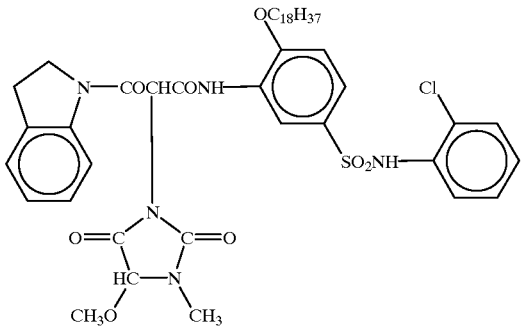

-continued
Oil-1
Dibutyl phthalate
Oil-2
Tricresyl phosphate
Oil-3
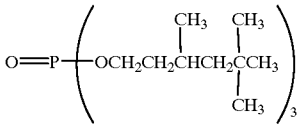
Oil-4
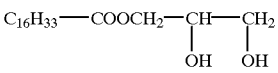
Cpd-A
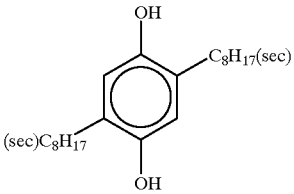
Cpd-B
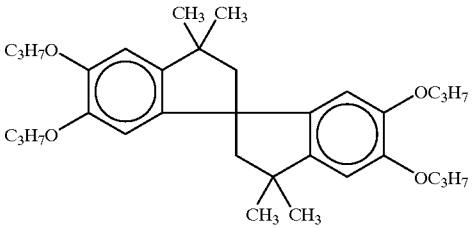
Cpd-C
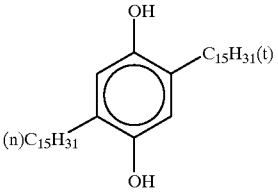
Cpd-D
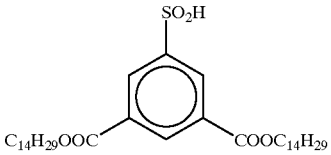
Cpd-E
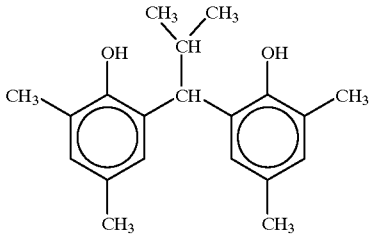
Cpd-F
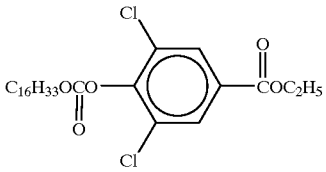

-continued
Cpd-G
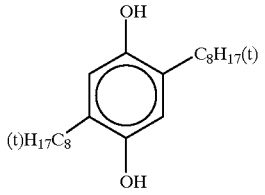
Cpd-H
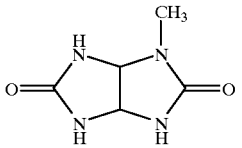
Cpd-I
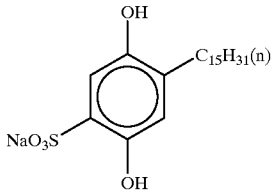
Cpd-J
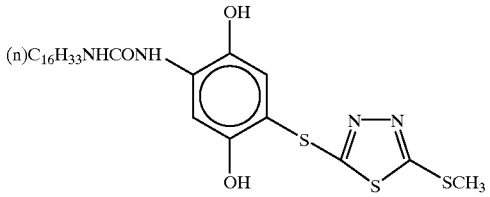
Cpd-K
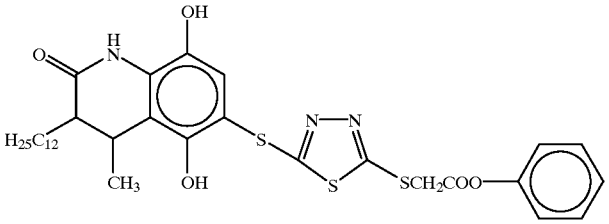
Cpd-L
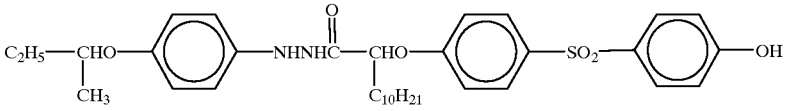
U-1
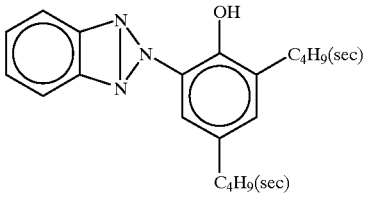

-continued
U-2
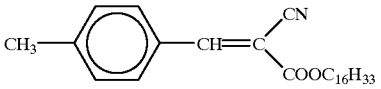
U-3
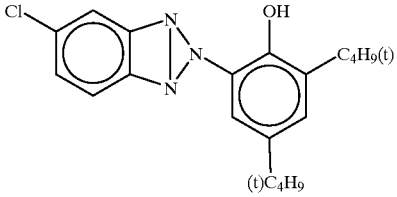
U-4
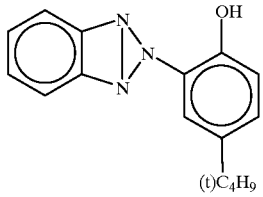
U-5
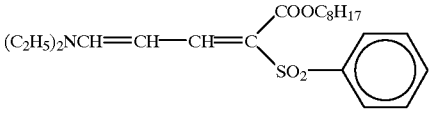
S-1
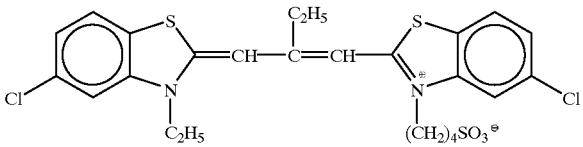
S-2
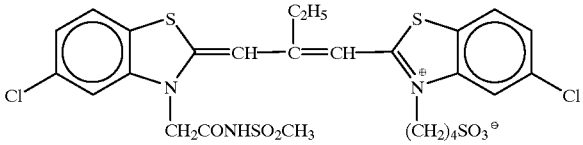
S-3
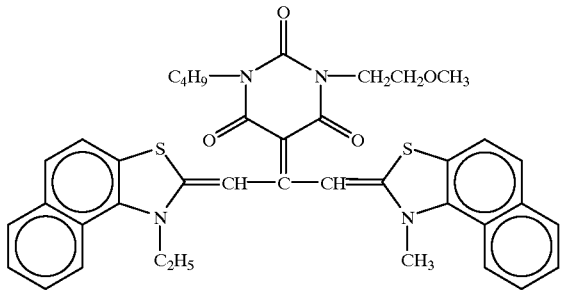
S-4
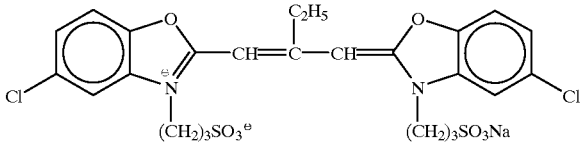

-continued
S-5
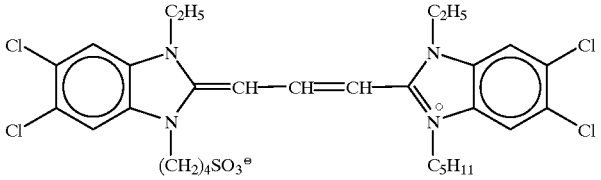
S-6
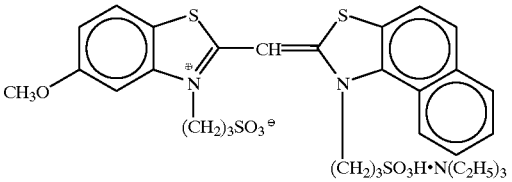
S-7
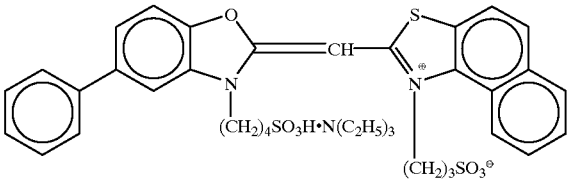
S-8
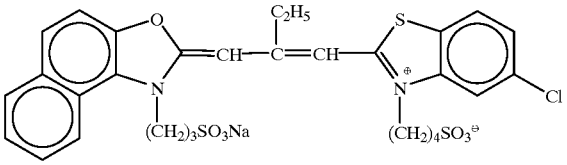
S-9
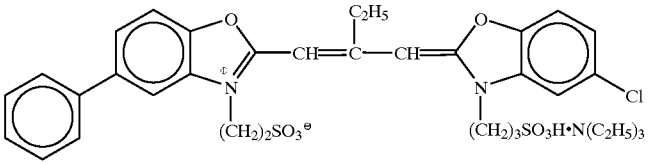
D-1
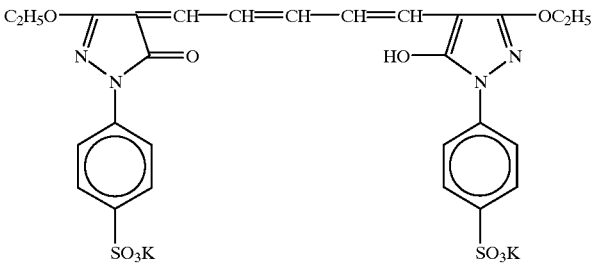
D-2
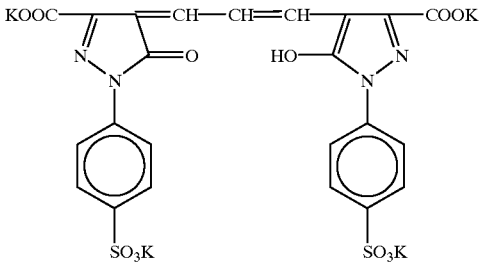

-continued
D-3
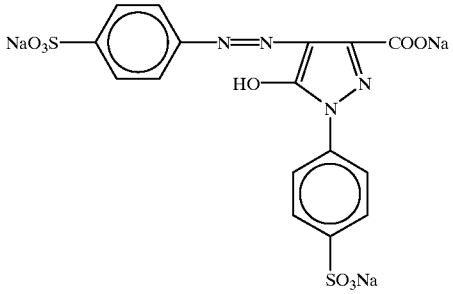
D-4
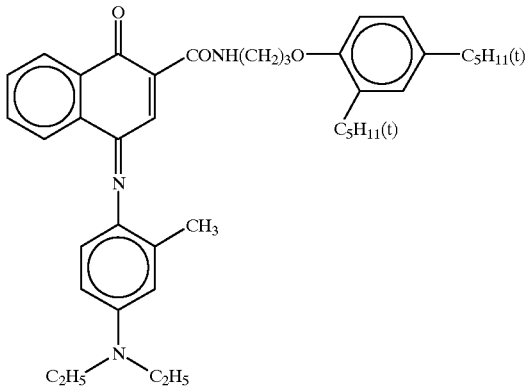
D-5
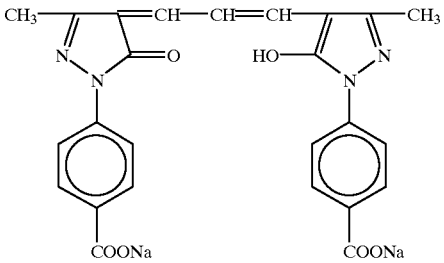
D-6
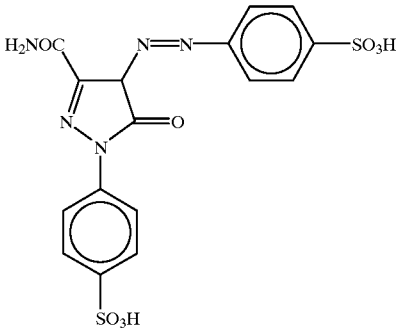
E-1
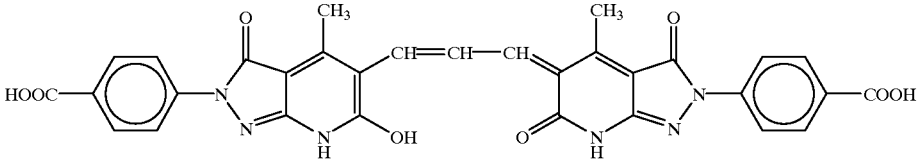
H-1
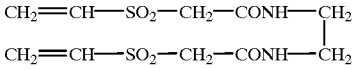

-continued
E-2
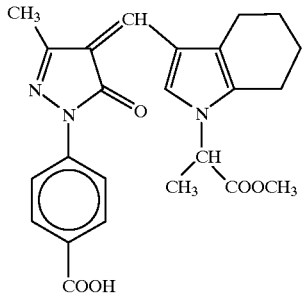
E-3
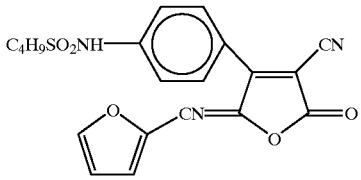
H-1
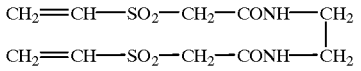
W-1
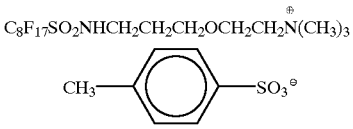
W-2
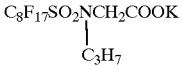
W-3
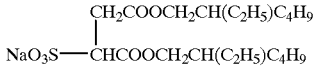
W-4
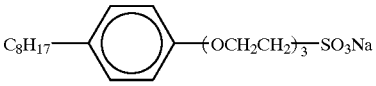
W-5
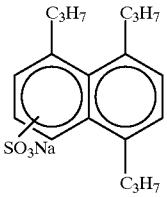
W-6
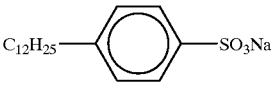
P-1
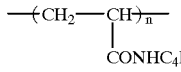
M-1
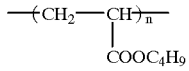

-continued
E-2
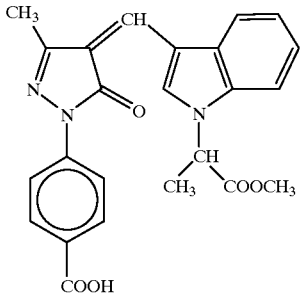
E-3
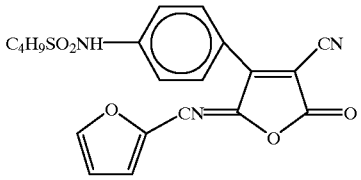
H-1
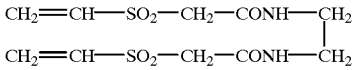
W-1
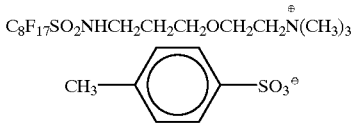
W-2
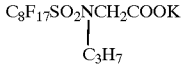
W-3
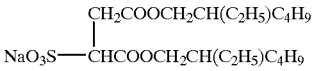
W-4
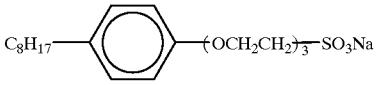
W-5
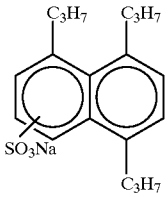
W-6
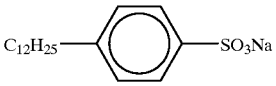

-continued
P-1
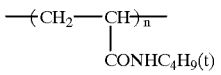
M-1
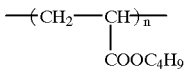
So-1
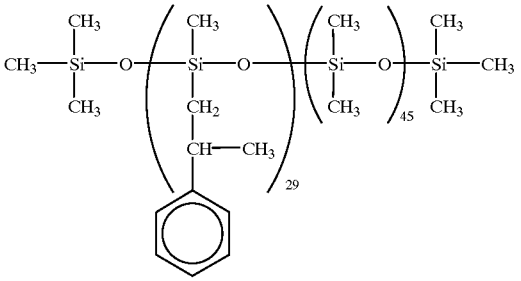
F-3
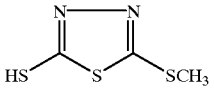

-continued
F-1
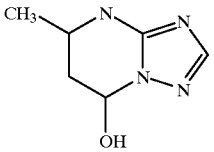
F-2
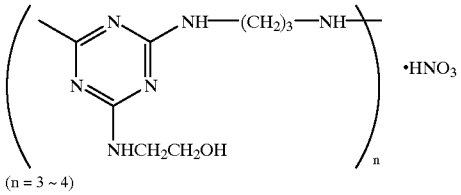
(n = 3 ~ 4)
F-3
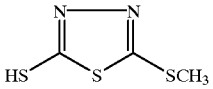
F-4
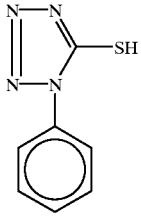
F-5
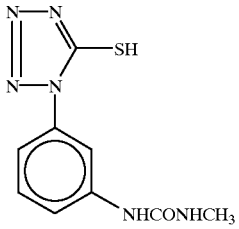
F-6
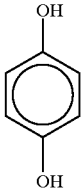
F-7
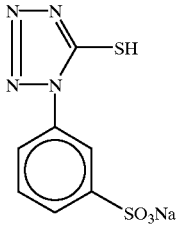
F-8
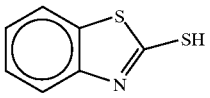

-continued
F-1
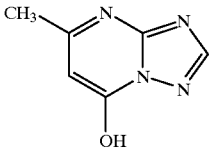
F-2
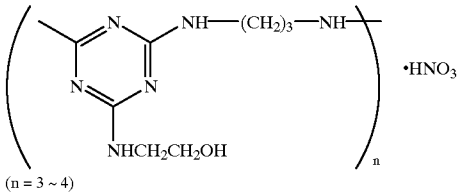
(n = 3 ~ 4)
F-3
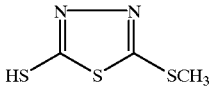
F-4
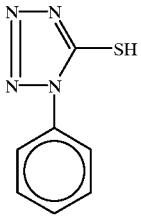
F-5
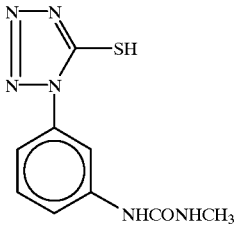
F-6
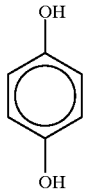
F-7
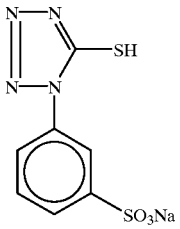
F-8
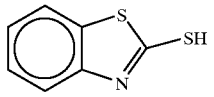

The silver iodobromide emulsions used in Sample 101 were as follows.

TABLE 1

| Emulsion | Properties of Grain | Average Equivalent-Sphere Grain Size (μm) | Coefficient of Variation (%) | AgI Content (%) |
|---|---|---|---|---|
| A | monodisperse tetra-decahedral grain | 0.28 | 16 | 4.0 |
| B | monodisperse cubic internal latent image type grain | 0.30 | 10 | 4.0 |
| C | monodisperse cubic grain | 0.38 | 10 | 5.0 |
| D | monodisperse tabular grain, average aspect ratio: 3.0 | 0.68 | 8 | 2.0 |
| E | monodisperse cubic grain | 0.20 | 17 | 4.0 |
| F | monodisperse tetra-decahedral grain | 0.25 | 16 | 4.0 |
| G | monodisperse cubic internal latent image type grain | 0.40 | 11 | 4.0 |
| H | monodisperse cubic grain | 0.50 | 9 | 3.5 |
| J | monodisperse cubic grain | 0.30 | 18 | 4.0 |
| K | monodisperse tetra-decahedral grain | 0.45 | 17 | 4.0 |
| L | monodisperse tabular grain, average aspect ratio: 5.0 | 0.55 | 10 | 2.0 |
| M | monodisperse tabular grain, average aspect ratio: 8.0 | 0.70 | 13 | 2.0 |
| N | monodisperse tabular grain, average aspect ratio: 6.0 | 1.00 | 10 | 1.5 |
| O | monodisperse tabular grain, average aspect ratio: 9.0 | 1.20 | 15 | 1.5 |

TABLE 2

Spectral Sensitization of Emulsions A to I

| Emulsion | Sensitizing Dye Added | Addition Amount per 1 mol of Silver Halide (g) |
|---|---|---|
| A | S-2 | 0.025 |
| | S-3 | 0.25 |
| | S-8 | 0.010 |
| B | S-1 | 0.010 |
| | S-3 | 0.25 |
| | S-8 | 0.010 |
| C | S-1 | 0.010 |
| | S-2 | 0.010 |
| | S-3 | 0.25 |
| | S-8 | 0.010 |
| D | S-2 | 0.010 |
| | S-3 | 0.10 |
| | S-8 | 0.010 |
| E | S-4 | 0.50 |
| | S-5 | 0.10 |
| F | S-4 | 0.30 |
| | S-5 | 0.10 |
| G | S-4 | 0.25 |
| | S-5 | 0.08 |
| | S-9 | 0.05 |
| H | S-4 | 0.20 |
| | S-5 | 0.060 |
| | S-9 | 0.050 |

TABLE 3

Spectral Sensitization of Emulsions J to N

| Emulsion | Sensitizing Dye Added | Addition Amount per 1 mol of Silver Halide (g) |
|---|---|---|
| J | S-6 | 0.050 |
| | S-7 | 0.20 |
| K | S-6 | 0.05 |
| | S-7 | 0.20 |
| L | S-6 | 0.060 |
| | S-7 | 0.22 |
| M | S-6 | 0.050 |
| | S-7 | 0.17 |
| N | S-6 | 0.040 |
| | S-7 | 0.15 |
| O | S-6 | 0.060 |
| | S-7 | 0.22 |

The thus-obtained Samples 101 to 112 each was exposed through a wedge for MTF measurement in the form of black/white rectangular wave in a sensitometry which was adjusted to a color temperature of 5,500° K., and then subjected to the following development. After the development, each sample was determined on the MTF value.

The Results Obtained are Shown in Table A.

As clearly seen from Table A, samples of the present invention are highly sensitive and excellent in the sharpness (high in the MTF value).

| Processing Step | Time (min) | Temperature (° C.) | Tank Volume (l) | Replenishing Amount (ml/m$^2$) |
|---|---|---|---|---|
| First development | 6 | 38 | 12 | 2,200 |
| First water washing | 2 | 38 | 4 | 7,500 |
| Reversal | 2 | 38 | 4 | 1,100 |
| Color development | 6 | 38 | 12 | 2,200 |
| Pre-bleaching | 2 | 38 | 4 | 1,100 |
| Bleaching | 6 | 38 | 12 | 220 |
| Fixing | 4 | 38 | 8 | 1,100 |
| Second water washing | 4 | 38 | 8 | 7,500 |
| Final rinsing | 1 | 25 | 2 | 1,100 |

Each processing solution had the following composition.

First Development

| | Tank Solution | Replenisher |
|---|---|---|
| Pentasodium nitrilo-N,N,N-trimethylene-phosphonate | 1.5 g | 1.5 g |
| Pentasodium diethylenetriaminepentaacetate | 2.0 g | 2.0 g |
| Sodium sulfite | 30 g | 30 g |
| Potassium hydroquinone · monosulfonate | 20 g | 20 g |
| Potassium carbonate | 15 g | 20 g |
| Sodium bisulfite | 12 g | 15 g |
| 1-Phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |

The pH was adjusted by sulfuric acid or potassium hydroxide.

Reversal Solution

| | Tank Solution | Replenisher |
|---|---|---|
| Pentasodium nitrilo-N,N,N-trimethylene-phosphonate | 3.0 g | same as tank solution |
| Stannous chloride dihydrate | 1.0 g | |
| p-Aminophenol | 0.1 g | |
| Sodium hydroxide | 8 g | |
| Glacial acetic acid | 15 ml | |
| Water to make | 1,000 ml | |
| pH | 6.00 | |

The pH was adjusted with acetic acid or sodium hydroxide.

Color developer

| | Tank Solution | Replenisher |
|---|---|---|
| Pentasodium nitrilo-N,N,N-trimethylene-phosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-N-(β-methanesulfonamidoethyl)-3-methyl-4-aminoaniline · 3/2 sulfuric acid monohydrate | 11 g | 11 g |
| 3,6-Dithiaoctan-1,8-diol | 1.0 g | 1.0 g |
| Water to make | 1,000 ml | 1,000 ml |
| pH | 11.80 | 12.00 |

The pH was adjusted with sulfuric acid or potassium hydroxide.

Pre-bleaching Solution

| | Tank Solution | Replenisher |
|---|---|---|
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde sodium bisulfite adduct | 30 g | 35 g |
| Water to make | 1,000 ml | 1,000 ml |
| pH | 6.30 | 6.10 |

The pH was adjusted with acetic acid or sodium hydroxide.

Bleaching Solution

| | Tank Solution | Replenisher |
|---|---|---|
| Disodium ethylenediaminetetraacetate dihydrate | 2.0 g | 4.0 g |
| Ammonium ethylenediaminetetraacetato · Fe (III) dihydrate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |

The pH was adjusted with nitric acid or sodium hydroxide.

Fixing Solution

| | Tank Solution | Replenisher |
|---|---|---|
| Ammonium thiosulfate | 80 g | same as tank solution |
| Sodium sulfite | 5.0 g | same as tank solution |
| Sodium bisulfite | 5.0 g | same as tank solution |
| Water to make | 1,000 ml | same as tank solution |
| pH | 6.60 | |

The pH was adjusted with acetic acid or aqueous ammonia.

Stabilizing Solution

| | Tank Solution | Replenisher |
|---|---|---|
| 1,2-Benzoisothiazolin-3-one | 0.02 g | 0.03 g |
| Polyoxyethylene-p-monononylphenyl ether (average polymerization degree: 10) | 0.3 g | 0.3 g |
| Polymaleic acid (average molecular weight: 2,000) | 0.1 g | 0.15 g |
| Water to make | 1,000 ml | 1,000 ml |
| pH | 7.0 | 7.0 |

TABLE A

| Sample No. | Emulsion Used | Outermost Layer Shell Composition | Sensitivity | MTF value (10 cycles/mm) | Remarks |
|---|---|---|---|---|---|
| 101 | Z1 | AgBr | 130 | 1.02 | Comparison |
| 102 | Z2 | $AgBr_{80}Cl_{20}$ | " | 1.10 | Invention |
| 103 | Z3 | $AgBr_{60}Cl_{40}$ | 135 | 1.12 | Invention |
| 104 | Z4 | $AgBr_{40}Cl_{60}$ | " | 1.14 | Invention |
| 105 | Z5 | $AgBr_{20}Cl_{80}$ | 140 | 1.16 | Invention |
| 106 | Z6 | AgCl | " | 1.16 | Invention |
| 107 | Z7 | AgBr | 100 | 1.02 | Comparison |
| 108 | Z8 | $AgBr_{80}Cl_{20}$ | " | 1.06 | Comparison |
| 109 | Z9 | $AgBr_{60}Cl_{40}$ | 103 | 1.09 | Comparison |

TABLE A-continued

| Sample No. | Emulsion Used | Outermost Layer Shell Composition | Sensitivity | MTF value (10 cycles/mm) | Remarks |
|---|---|---|---|---|---|
| 110 | Z10 | $AgBr_{40}Cl_{60}$ | " | 1.09 | Comparison |
| 111 | Z11 | $AgBr_{20}Cl_{80}$ | 105 | 1.10 | Comparison |
| 112 | Z12 | AgCl | " | 1.10 | Comparison |

EXAMPLE 2

Using the sixth layer of Sample 101 in Example 1 as the objective layer, Samples 201 to 212 were prepared and evaluated in the same manner as in Example 1, and the effect of the present invention on the red-sensitive layer was verified. As a result, similar results to those in Example 1 were obtained.

EXAMPLE 3

Using the seventeenth layer of Sample 101 in Example 1 as the objective layer, Samples 301 to 312 were prepared and evaluated in the same manner as in Example 1, and the effect of the present invention on the blue-sensitive layer was verified. As a result, similar results to those in Example 1 were obtained.

EXAMPLE 4

Preparation of Comparative Emulsion I11:

1,200 ml of an aqueous solution containing 180 g of Seed Emulsion h1, 1.9 g of KBr and 38 g of gelatin was stirred while keeping it at 78° C. After adding thereto 0.5 mg of thiourea dioxide, an aqueous $AgNO_3$ (87.7 g) solution and an aqueous KBr solution were added by a double jet method over 46 minutes while accelerating the flow rate. At this time, the silver potential was kept at −40 mV to the saturation calomel electrode. Thereafter, an aqueous $AgNO_3$ (42.6 g) solution and an aqueous KBr solution were added by a double jet method over 17 minutes. At this time, the silver potential was kept at +40 mV to the saturation calomel electrode.

The silver potential was adjusted to −10 mV by adding 44 mg of sodium ethylthiosulfonate and an aqueous KBr solution. Then, $AgNO_3$ (7.1 g) and an aqueous KI solution (6.93 g) were added by a double jet method over 5 minutes at a constant rate. After the addition, the silver potential was −10 mV. The resulting emulsion was washed with water in a usual manner, gelatin was added thereto, and the pH and the pAg were adjusted at 40° C. to 5.8 and 8.8, respectively.

Emulsion I11 comprised tabular grains having an equivalent-circle average diameter of 1.17 μm, a coefficient of variation of the equivalent-circle diameter of 19%, an average thickness of 0.23 μm, an average aspect ratio of 5.0 and an equivalent-sphere average diameter of 0.78 μm, and grains having an aspect ratio of 3 or more occupied 80% or more of the entire projected area.

Preparation of Emulsion I12 of the Present Invention:

1,200 ml of an aqueous solution containing 180 g of Seed Emulsion h1, 1.9 g of KBr and 38 g of gelatin was stirred while keeping it at 78° C. After adding 0.5 mg of thiourea dioxide, an aqueous $AgNO_3$ (87.7 g) solution and an aqueous KBr solution were added by a double jet method over 46 minutes while accelerating the flow rate. At this time, the silver potential was kept at −40 mV to the saturation calomel electrode. Thereafter, an aqueous $AgNO_3$ (42.6 g) solution, an aqueous KBr (23.9 g) solution and an aqueous NaCl solution (2.94 g) were added by a triple jet method over 17 minutes. At this time, the silver potential was kept at +40 mV to the saturation calomel electrode.

The silver potential was adjusted to −10 mV to by adding 44 mg of sodium ethylthiosulfonate and an aqueous KBr solution. Then, $AgNO_3$ (7.1 g) and an aqueous KI solution (6.93 g) were added by a double jet method over 5 minutes at a constant rate. After the addition, the silver potential was −10 mV. The resulting emulsion was washed with water in a usual manner, gelatin was added, and the pH and the pAg were adjusted at 40° C. to 5.8 and 8.8, respectively.

Emulsion I12 comprised tabular grains having an equivalent-circle average diameter of 1.17 μm, a coefficient of variation of the equivalent-circle diameter of 19%, an average thickness of 0.23 μm, an average aspect ratio of 5.0 and an equivalent-sphere average diameter of 0.78 μm. Grains having an aspect ratio of 3 or more occupied 80% or more of the entire projected area.

Emulsions I13 to I16 shown in Table B below were prepared in the same manner by changing the Br/Cl ratio in the aqueous silver salt solution at the second stage.

Emulsions I13 to I16 each comprised tabular grains having an equivalent-circle average diameter of 1.17 μm, a coefficient of variation of the equivalent-circle diameter of 19%, an average thickness of 0.23 μm, an average aspect ratio of 5.0 and an equivalent-sphere average diameter of 0.78 μm, and grains having an aspect ratio of 3 or more occupied 80% or more of the entire projected area.

Preparation of Comparative Emulsion I21:

1,200 ml of an aqueous solution containing 180 g of Seed Emulsion h1, 1.9 g of KBr and 38 g of gelatin was stirred while keeping it at 78° C. After adding thereto 0.5 mg of thiourea dioxide, an aqueous $AgNO_3$ (87.7 g) solution, an aqueous KBr solution and an aqueous KI solution (2.6 mol % based on the amount of silver added) were added by a triple jet method over 46 minutes while accelerating the flow rate. At this time, the silver potential was kept at −40 mV to the saturation calomel electrode. Thereafter, an aqueous $AgNO_3$ (42.6 g) solution and an aqueous KBr solution were added by a double jet method over 17 minutes. At this time, the silver potential was kept at +40 mV to the saturation calomel electrode.

The silver potential was adjusted to −10 mV by adding 44 mg of sodium ethylthiosulfonate and an aqueous KBr solution. Then, $AgNO_3$ (66.4 g) and an aqueous KBr solution (46.5 g) were added by a double jet method over 20 minutes. At this time, the silver potential was kept at −10 mV to the saturation calomel electrode. The resulting emulsion was washed with water in a usual manner, gelatin was added thereto, and the pH and the pAg were adjusted at 40° C. to 5.8 and 8.8, respectively.

Emulsion I21 comprised tabular grains having an equivalent-circle average diameter of 1.20 μm, a coefficient of variation of the equivalent-circle diameter of 19%, an average thickness of 0.22 μm, an average aspect ratio of 5.5 and an equivalent-sphere average diameter of 0.78 μm, and grains having an aspect ratio of 3 or more occupied 80% or more of the entire projected area.

Preparation of Comparative Emulsion I22:

1,200 ml of an aqueous solution containing 180 g of Seed Emulsion h1, 1.9 g of KBr and 38 g of gelatin was stirred while keeping it at 78° C. After adding 0.5 mg of thiourea dioxide, an aqueous $AgNO_3$ (87.7 g) solution and an aqueous KBr solution were added by a double jet method over 46 minutes while accelerating the flow rate. At this time, the silver potential was kept at −40 mV to the saturation calomel electrode. Thereafter, an aqueous $AgNO_3$ (42.6 g) solution, an aqueous KBr (23.9 g) solution and an aqueous NaCl solution (2.94 g) were added by a triple jet method over 17 minutes. At this time, the silver potential was kept at +40 mV to the saturation calomel electrode.

The silver potential was adjusted to −10 mV to by adding 44 mg of sodium ethylthiosulfonate and an aqueous KBr solution. Then, $AgNO_3$ (66.4 g) and an aqueous KBr solution (46.5 g) were added by a double jet method over 20 minutes. At this time, the silver potential was kept at −10 mV to the saturation calomel electrode. The resulting emulsion was washed with water in a usual manner, gelatin was added, and the pH and the pAg were adjusted at 40° C. to 5.8 and 8.8, respectively.

Emulsion I22 comprised tabular grains having an equivalent-circle average diameter of 1.20 μm, a coefficient of variation of the equivalent-circle diameter of 19%, an average thickness of 0.22 μm, an average aspect ratio of 5.5 and an equivalent-sphere average diameter of 0.78 μm, and grains having an aspect ratio of 3 or more occupied 80% or more of the entire projected area.

Emulsion I23 shown in Table B below was prepared in the same manner by changing the Br/Cl ratio in the aqueous silver salt solution at the second stage.

Emulsion I23 comprised tabular grains having an equivalent-circle average diameter of 1.20 μm, a coefficient of variation of the equivalent-circle diameter of 19%, an average thickness of 0.22 μm, an average aspect ratio of 5.5 and an equivalent-sphere average diameter of 0.78 μm, and grains having an aspect ratio of 3 or more occupied 80% or more of the entire projected area.

Emulsions I11 to I16 and Emulsions I21 to I26 were observed through a transmission-type electron microscope of 400 kv at a liquid nitrogen temperature. As a result, in grains of Emulsion I11 to I16, dislocation lines were present at a high density at the fringe portion of a tabular grain. On the other hand, no dislocation line was observed at the fringe portion of a tabular grain of Emulsions I21 to I23.

Emulsions I11 to I16 each was subjected to optimal chemical sensitization by elevating the temperature to 60° C. and adding dipotassium hexachloroiridate, Sensitizing Dyes S4, S5 and S9, potassium thiocyanate, chloroauric acid, sodium thiosulfate and N,N-dimethylselenourea.

Preparation of Coated Sample:

Multi-layer color light-sensitive materials 401 to 409 were prepared in the same manner as in the preparation of multi-layer color light-sensitive materials of Example 1 using one of Emulsions I11 to I16 and Emulsions I21 to I23 in the ninth layer.

The thus-prepared Samples 401 to 409 were subjected to exposure and development for calculating the sensitivity and to exposure and development for calculating the MTF value, in the same manner as in Example 1.

The Results Obtained are Shown in Table B.

It is apparent from Table B that the samples of the present invention is highly sensitive and high in the MTF that is, excellent in the sharpness.

TABLE B

| Sample No. | Emulsion Used | Composition of Core Emulsion 2nd Layer | Sensitivity | MTF value | Remarks |
|---|---|---|---|---|---|
| 401 | I11 | AgBr | 128 | 1.02 | Comparison |
| 402 | I12 | $AgBr_{80}Cl_{20}$ | 135 | 1.10 | Invention |
| 403 | I13 | $AgBr_{60}Cl_{40}$ | 140 | 1.12 | Invention |
| 404 | I14 | $AgBr_{40}Cl_{60}$ | 140 | 1.16 | Invention |
| 405 | I15 | $AgBr_{20}Cl_{80}$ | 140 | 1.17 | Invention |
| 406 | I16 | AgCl | 140 | 1.18 | Invention |
| 407 | I21 | AgBr | 100 | 1.09 | Comparison |
| 408 | I22 | $AgBr_{80}Cl_{20}$ | 101 | 1.11 | Comparison |
| 409 | I23 | $AgBr_{60}Cl_{40}$ | 101 | 1.10 | Comparison |

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one silver halide emulsion layer containing silver chloroiodobromide grains at a proportion of 60% or more of the entire projected area, wherein said silver chloroiodobromide grains are tabular grains each having (i) at least one dislocation line and (ii) an aspect ratio of from 1.5 to 100, and have a multi-layer structure comprising a core and at least one shell, in which the core and shell have a different halogen composition, wherein said silver chloroiodobromide grains have an outermost layer containing silver chloride in an amount of from 10 to 100 mol %.

2. A silver halide photographic light-sensitive material as claimed in claim 1, wherein said silver chloroiodobromide grains have been subjected to selenium sensitization in the presence of a sensitizing dye.

3. A silver halide photographic light-sensitive material as claimed in claim 1, wherein said silver chloroiodobromide grains have been subjected to reduction sensitization.

4. A silver halide photographic light-sensitive material as claimed in claim 2, wherein said silver chloroiodobromide grains have been subjected to reduction sensitization.

5. A silver halide photographic light-sensitive material as claimed in claim 1, which is a color reversal light-sensitive material.

6. A silver halide photographic light-sensitive material as claimed in claim 1, wherein said at least one dislocation line has been introduced by using fine grain silver iodide.

* * * * *